US006003524A

United States Patent [19]

Gravelle

[11] Patent Number: 6,003,524

[45] Date of Patent: Dec. 21, 1999

[54] HAIR SPRAY SHIELD

[76] Inventor: Irene T. Gravelle, 659 Chester Ave., Elgin, Ill. 60120

[21] Appl. No.: 09/103,195

[22] Filed: Jun. 23, 1998

[51] Int. Cl.[6] ..... A45D 40/30; A45D 7/02; A41D 13/00; A42B 1/18

[52] U.S. Cl. ..... 132/319; 132/212; 2/9; 2/174; 2/173

[58] Field of Search ..... 132/319, 212, 132/333; 2/9, 173, 174, 175, 206, 11, 8; 4/159

[56] References Cited

U.S. PATENT DOCUMENTS

| | | | |
|---|---|---|---|
| 1,906,539 | 5/1933 | Church | 2/174 |
| 3,041,624 | 7/1962 | Cutrona, Jr. . | |
| 3,261,027 | 7/1966 | Lambert . | |
| 3,317,921 | 5/1967 | Zarzour | 2/9 |
| 3,602,913 | 9/1971 | Neese . | |
| 3,772,707 | 11/1973 | Alosi et al. | 2/174 |
| 3,916,917 | 11/1975 | Hubbert | 132/9 |
| 3,963,034 | 6/1976 | Runberg et al. . | |
| 4,428,079 | 1/1984 | Mckee | 2/174 |
| 4,837,861 | 6/1989 | Cole | 2/9 |
| 5,135,013 | 8/1992 | DePaolo . | |
| 5,642,528 | 7/1997 | Dering . | |

*Primary Examiner*—John J. Wilson
*Assistant Examiner*—Trang Doan
*Attorney, Agent, or Firm*—Mathew R. P. Perrone, Jr.

[57] ABSTRACT

A hair spray shield has two flexible sides permanently joined together by a hinge at one point and releasably joined at another point by a releasable fastening device.

17 Claims, 4 Drawing Sheets

HAIR SPRAY SHIELD

This invention relates to a hair spray shield, and more particularly to a flexible hair spray shield having an number of available sides for shielding a person's face during the use of hair spray, or application of hair spray to hair.

BACKGROUND OF THE INVENTION

Hair spray is a well known hair styling composition commonly used. It has the ability to provide hold for hair to keep the hair in a desired position for an extended period of time. This quietly simplifies hair styling and permits the person to have more time to concentrate on other matters, while knowing that at least one aspect of appearance is well contained.

However, hair spray can be an irritant to the skin. Not only can hair spray be irritating to the skin, it may also be an irritant to the eyes and other sensitive parts of the body during the application thereof to the hair.

In an attempt to overcome this problem, many devices are known in the prior art. One type of device that exists is a facial mask. These facial masks usually have a complex configuration. These masks are also rigid, which reduces the flexibility in using the mask. The masks, in addition, are larger and heavier than necessary. With a larger and heavier shield, the device is less convenient to use.

Another problem with such a shield, is that it becomes coated with hair spray during the course of use. This creates a problem. It is sometimes necessary to clean the shield during the course of the hair spray application, after such problems, indicated that the shield causes more problems than it solves. It is desired to avoid these problems.

Such masks are too large to selective cover parts of the face. It is either cover the entire face, or use the device inefficiently. Such inefficient use is ineffective for the desired protection.

Additionally, such facial masks tend to be left to the beautician. The beautician uses the mask. Such a mask is cumbersome and awkward to use at home. Thus, it is desired to find a shield that could be more easily used.

SUMMARY OF THE INVENTION

Among the many objectives of this invention is the provision of a hair spray shield having two joinable, flattened sides hinged together at an adjoining edge.

Another objective of this invention is to provide a hair spray shield having more than one surface suitable for use as a shied during a application of hair spray.

Yet another objective of this invention is to provide a hair spray shield capable of selectively shielding a portion of the face.

Still another objective of this invention is to provide a hair spray shield, which is adjustable.

Additionally, an objective of this invention is to provide a hair spray shield, which permits selective protection of an area of the face.

Also, an objective of this invention is to provide a hair spray shield, which can minimize the difficulty in obtaining a precise positioning required for a hair spray shield.

A further objective of this invention is to provide a hair spray shield, which is easily used.

A still further objective of this invention is to provide a hair spray shield, which permits in place adjustment for protection a desired area of the face.

Yet a further objective of this invention is to provide a hair spray shield, which avoids damage to the skin.

These and other objectives of the invention (which other objectives become clear by consideration of the specification, claims and drawings as a whole) are met by providing a hair spray shield, including two flexible sides permanently joined together by a hinge at one point and releasably joined at another point by a releasable fastening device.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
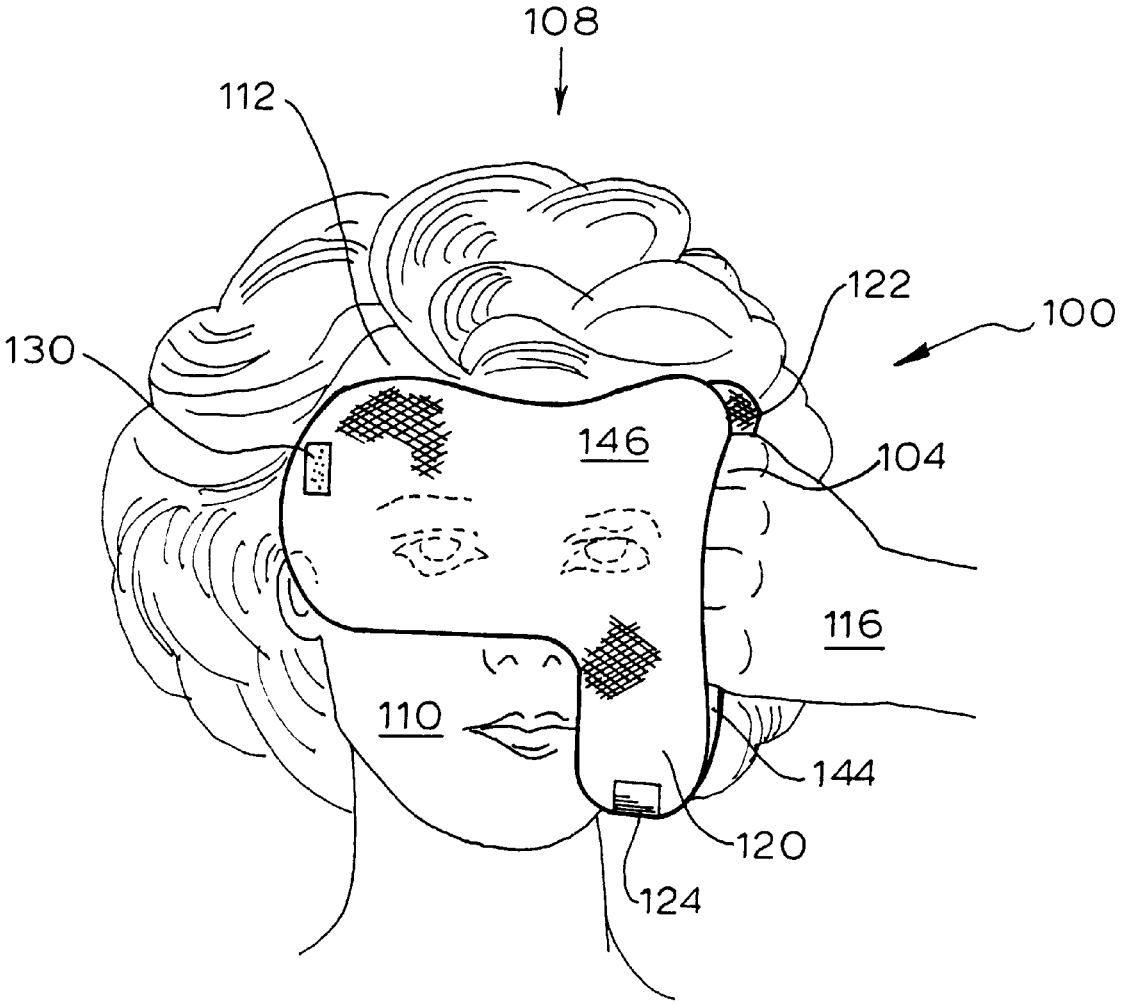
FIG. 1 depicts a perspective view of the hair spray shield 100 used on a face 110 to cover the forehead 112.

The hair spray shield of this invention is a hinged two piece or two-sided item. The two sides may be folded over one another and secured together as they are connected by a hinge. The hinge permits the sides to be folded back and forth over the other, in order to provide four protecting surfaces.

The sides may also be modified with a removable securing device. Typical securing devices are the hook and loop assemblies commonly known and sold under the trademark VELCRO. The two pieces rotate at a hinge to effectively present four different surfaces for use.

In a preferred structure, a foam or flexible paper is in the center with an absorbing fabric panel or other similar material secured to the outside by glue or other suitable means. Each side may also be formed of one to five sheets by laminating, molding or suitable forming procedure.

The hair spray shield is curved inwardly and outwardly to achieve the desired results. Preferably, each side has total thickness counting all the layers of about 0.1 centimeter to about 2.0 centimeters. More preferably, each side has total thickness counting all the layers of about 0.2 centimeter to about 1.5 centimeters. Most preferably, each side has total thickness counting all the layers of about 0.3 centimeter to about 1.2 centimeters.

A hinge is achieved by a flexible bond paper or cloth that may be secured to the hinge point of each flattened side. Preferably, the hinge point of one flattened side is placed adjacent to the hinge point of the second flattened side. The flexible paper or cloth is glued welded or otherwise secured to each flattened side. The two flattened sides are then turned over. A second flexible paper or cloth is glued welded or otherwise secured to each flattened side.

Between each flattened side, the first flexible paper or clothe adheres to the second paper or cloth, thereby providing a hinged effect. With the binding material, each piece can be folded back and forth to the achieved desired results, of providing four protecting surfaces.

In operation, the hair spray shield has a first shield attached to a second shield by a hinge. In operation either the first shield or the second shield is grasped by either the left hand or the right hand. Preferably, the thumb is on top and the four fingers underneath the outer curve or between the shields. The hinge and the releasable securing device combine to permit the hairspray shield to be held on the fingers.

Each shield has an ear section as a shorter side or area. Usually, the shorter side is facing the user. The hair spray shield is then placed over the opposite ear with the shorter side on the ear, and the taller and wider side on the temple. The finger tips are usually covered, allowing the user to apply hair spraying products to style the hair.

When that portion of the hair spray is finished, with the opposite hand grasps the bottom shield, thumb on the bottom, and four fingers on the top of the outer curve. The shield is them inverted by the same hand to cover the other ear with the small end (shorter side), and the taller and wider side on the temple allowing the user to apply hair spraying products to that side.

The protective shield can also be placed over the forehead with the tall end (taller and wider side) covering the forehead and the small end is held in the hand. Thus the entire head can be protected, with the various positions.

If one of the sides of the hair spray receives an over accumulation of hair spray on it, the user has an alternate method of operation. The hair spray shield is opened toward the user, like turning a page. Then, the VELCRO secures the reverse sides of the first shield and second shield to together. The user, will in this manner, have a new side (dry) toward the skin.

Other fasteners may used. Typical of these fasteners are tape, snaps, releasable glue. The fastener requirement is that it joins the first shield to the second shield on either, but that the fastener also be easily releasable.

This curved shape of hair spray shield renders the skill to concentrate or focus on a particular area, while it protects and shields the ear and skin of one's forehead (temple) and with a compartment, protects the fingertips from overspray when using hair related spray products to style the hair. Although shaped for the ear and temple, the flat shield or flattened side follows the contour of the hair line and will protect the ear and temple from contamination, that is being coated by hair spray during the application procedure.

Referring now to FIG. 1, the hair spray shield 100 has a first shield 120 and a second shield 122, joined by a flexible hinge 124. The hair spray shield 100 used by a woman 108 is on her face 110 to cover her forehead 112. The hinge 124 permits the shields 120 and 122 to be folded back and forth, one over the other at the hinge 124, in order to provide four protecting surfaces.

The structure of hair spray shield 100 is shown as used by the woman 108. It is clear, from this disclosure, that the hair spray shield 100 is usable by a male or female of any age.

The shields 120 and 122 may also be modified with at least one hook and loop assembly 130. A typical example of hook and loop assembly 130 is commonly known and sold under the trademark VELCRO. The two pieces rotate at a hinge to effectively present four different surfaces for use.

Due to the first shield 120 being substantially similar in shape to the second shield 122, a desired hair spray shield 100 is formed. The hinge 124 combines with the at least one hook and loop assembly 130 in order to permit first shield 120 to be held adjacent to second shield 122.

Figure 2:
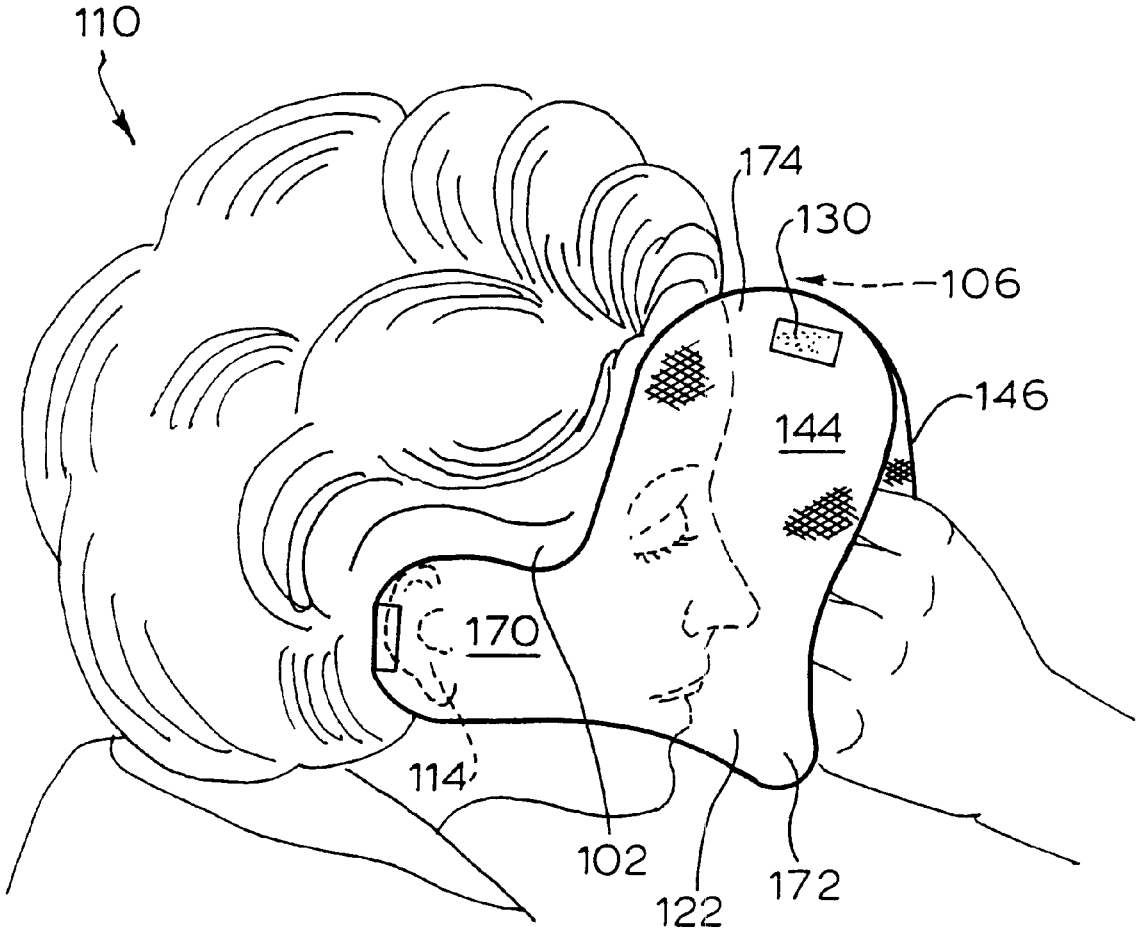
FIG. 2 depicts a perspective view of the hair spray shield 100 used on a face 110 to cover the ear 114, which is also a reverse view of shield 100 as shown in FIG. 1.
Figure 3:
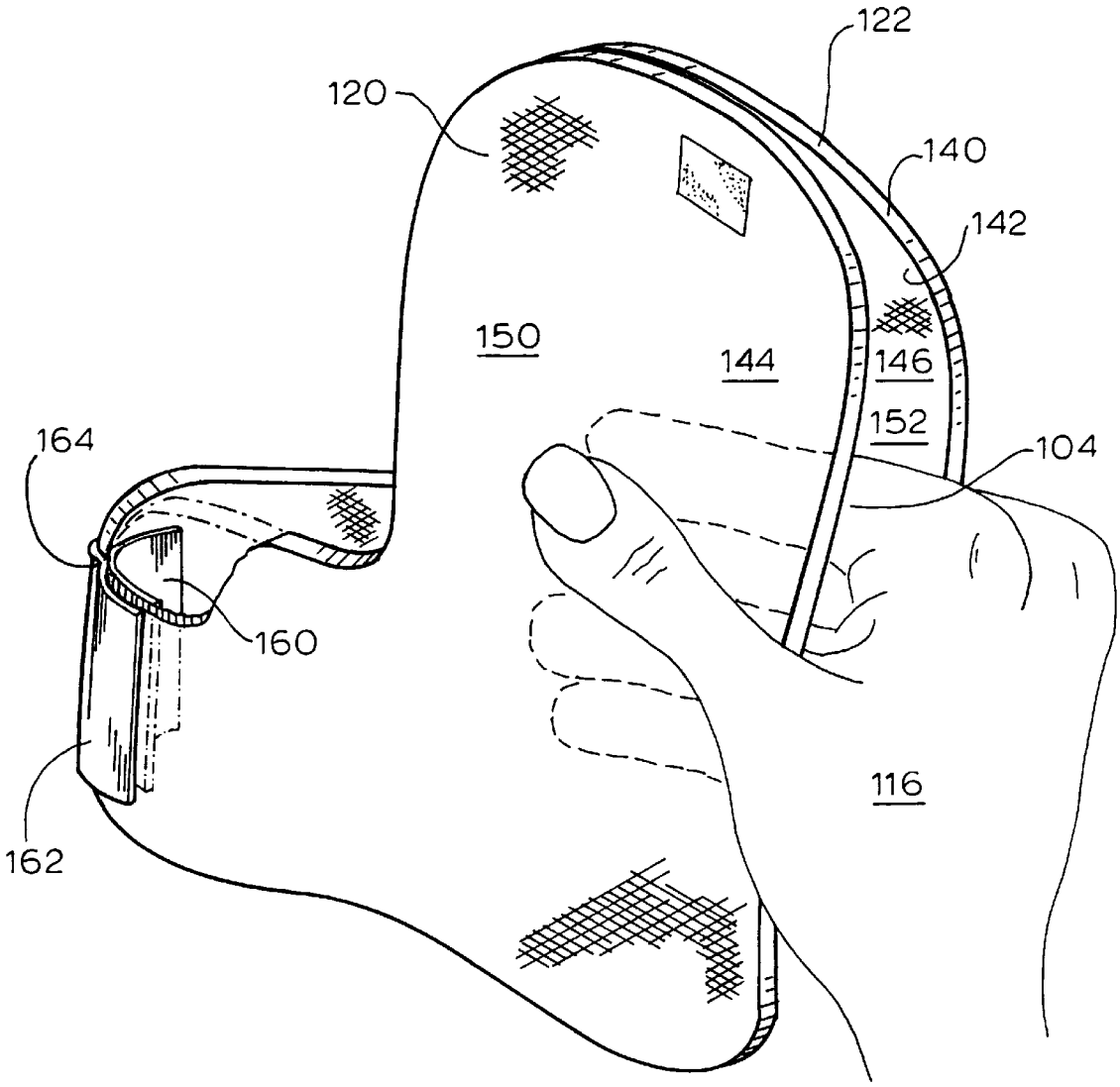
FIG. 3 depicts a perspective view of the hair spray shield 100 showing one suitable position of a hand 116.

Adding FIG. 2 and FIG. 3 to the consideration, shields 120 and 122, in a preferred structure, have a foam or flexible paper 140 in the center of a laminate 142. To complete laminate 142, a first absorbing fabric panel 144 is glued or otherwise secured to the flexible paper 140 on a first side 150 of flexible paper 140. Likewise, a second absorbing fabric panel 146 is glued or otherwise secured to the flexible paper 140 on a second side 152 of flexible paper 140.

Figure 4:
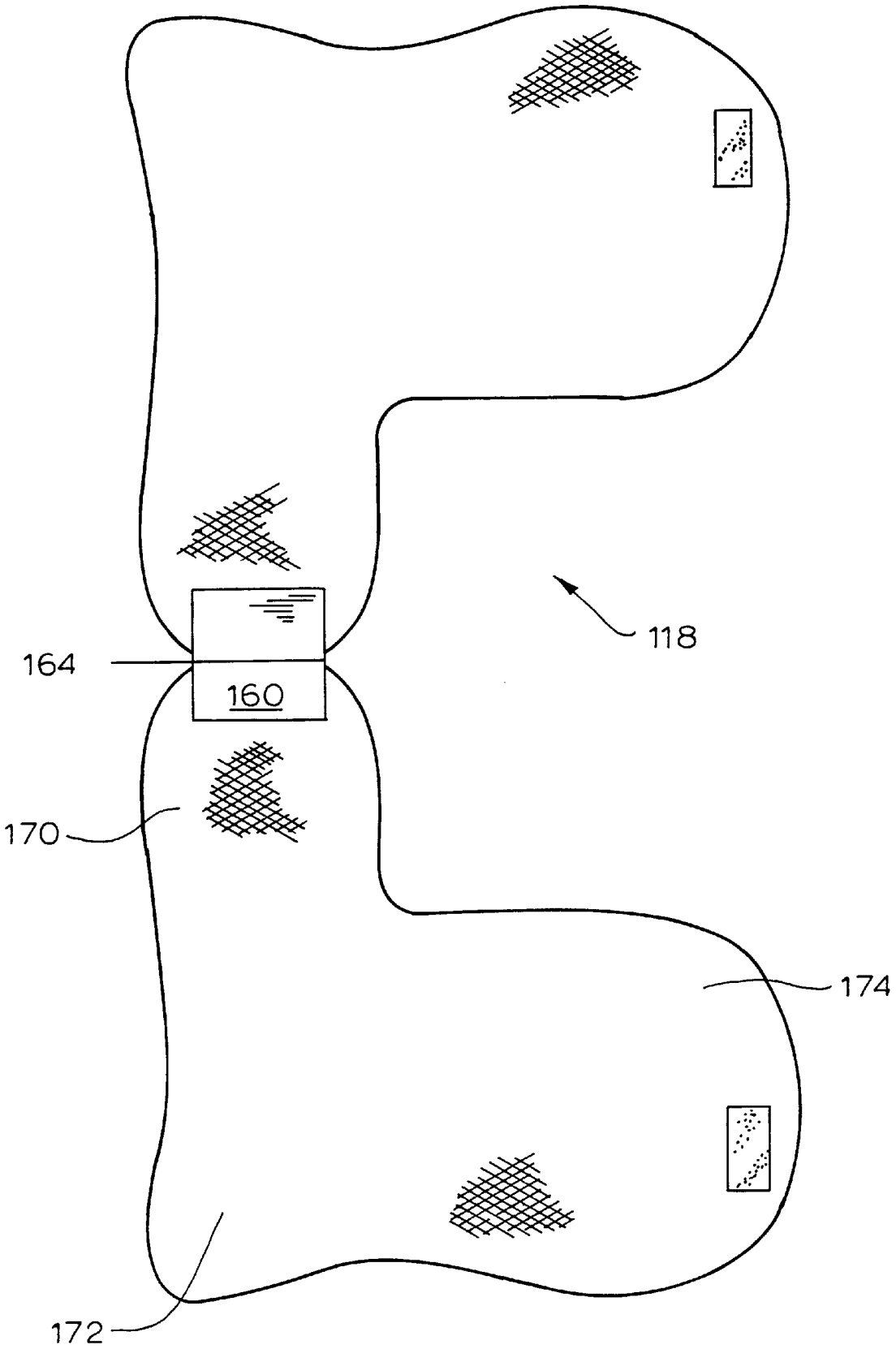
FIG. 4 depicts a plan view of hair spray shield 100 in an interior open position 118.

With the further consideration of FIG. 4, hinge 124 is achieved by a first sheet 160 of flexible bond paper or cloth that may be secured to first shield 120 and second shield 122, thereby joining them together. A second sheet 162 of flexible bond paper or cloth may be secured to first shield 120 and second shield 122. At a center line 164, second sheet 162 joins first sheet 160 to strengthen hinge 124. This structure provides folding flexibility.

In operation, the hair spray shield 100 may have first shield 120 removably secured to second shield 122 by hook and loop assembly 130 and supported by hinge 124. In operation either the first shield 120 has first side 150 adjacent to second side 152 of second shield 122; or the first shield 120 has second side 152 adjacent to first side 150 of second shield 122.

With the hinge 124 and two opposing hook and loop assembles 130, both sides of first shield 120 and second shield 122 may be used. The hair spray coated surface may be concealed and hair spray surface may be used.

Each shield 120 or 122 has an ear section 170 as a shorter side. Usually, the ear section 170 or shorter side is facing the user 110 (FIG. 2). The hair spray shield 100 is then placed over the opposite ear 106 with the small end or ear section 170, adjacent to or covering the ear 106.

Ear Section 170 extends from a heel section 172. Perpendicular to ear section 170 and also extending from heel section 172 is tall end 174 on the temple 102. Tall end 174 usually covers the temple 102 or the forehead 112, when hairspray shield 100 is in use. The finger tips 104 are usually covered, allowing the user to apply hair spraying products to style the hair. Heel section 172, ear section 170 and tall end 174 are the designated parts of and do form both first shield 120 and second shield 122.

First shield 120 and second shield 122 are joined by hinge 124. Due to cooperation of hook and loop assemblies 130, the hair spray shield 100 of this invention becomes useful.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A flexible hairspray shield, the hair spray shield comprising:

(a) a first flattened side being connected to a second flattened side;

(b) a movable connecting means joining the first flattened side to the second flattened side;

(c) the first flattened side being substantially similar in shape to the second flattened side;

(d) a releasable connecting means realizable joining the first flattened side to the second flattened side;

(e) the movable connecting means being a flexible hinge;

(f) the releasable connecting means being a hook and loop assembly;

(g) the flexible hinge having a first flexible member and a second flexible member;

(h) the first flexible member being joined to the second flexible member at a center portion thereof;

(i) the first flexible member and the second flexible member each having adjacent first ends oppositely disposed from adjacent second ends;

(j) the adjacent first ends being secured to the first flattened side on opposite flat surfaces thereof; and (k) the adjacent second ends being secured to the first flattened side to the second flattened side on opposite flat surfaces thereof.

2. The flexible hairspray shield of claim 1, further comprising:

(a) the flexible hinge having a first flexible member and a second flexible member;

(b) the first flexible member being joined to the second flexible member at a center portion thereof;

(c) the first flexible member and the second flexible member each having adjacent first ends oppositely disposed from adjacent second ends;

(d) the adjacent first ends being secured to the first flattened side on opposite flat surfaces thereof; and (e) the adjacent second ends being secured to the first flattened side to the second flattened side on opposite flat surfaces thereof.

3. The flexible hairspray shield of claim 1, further comprising:

(a) the first flattened side being positionable adjacent to the second flattened side; and (b) the first flattened side being alternatively and reversibly positionable adjacent to the second flattened side; thereby permitting four usable surfaces of the flexible hairspray shield.

4. The flexible hairspray shield of claim 3, further comprising:

(a) the first flattened side and the second flattened side each having a center portion;

(b) the center portion having a first coverable side and a second coverable side;

(c) a first covering for the first coverable side; and (d) a second covering for the second coverable side.

5. The flexible hairspray shield of claim 4, further comprising:

(a) the center portion having a structure selected from the group consisting of a foam structure and a flexible paper structure; and (b) the first covering and the second covering being selected from the group consisting of an absorbing woven fabric panel and a sheet panel.

6. The flexible hairspray shield of claim 3 further comprising:

(a) the first flattened side and the second flattened side being selected from the group consisting of a laminated sheet and a molded sheet; and (b) the flexible hair spray shield having at least one inwardly curved section and at least one outwardly curved section.

7. The flexible hairspray shield of claim 6 further comprising the first flattened side and the second flattened side each having a thickness of about 0.1 centimeter to about 2.0 centimeters.

8. The flexible hairspray shield of claim 5 further comprising:

(a) the first flattened side and the second flattened side being selected from the group consisting of a laminated sheet and molded sheet; and (b) the flexible hair spray shield having at least one inwardly curved section and at least one outwardly curved section.

9. The flexible hairspray shield of claim 8 further comprising the first flattened side and the second flattened side each having a thickness of about 0.1 centimeter to about 2.0 centimeters.

10. The flexible hairspray shield of claim 8 further comprising the first flattened side and the second flattened side each having a thickness of about 0.3 centimeter to about 1.2 centimeters.

11. The flexible hairspray shield of claim 8 further comprising:

(a) the first flattened side having an ear-covering section as a shorter side;

(b) the first flattened side having a temple-covering section as a taller side; and (b) the taller side being substantially perpendicular to the shorter side.

12. The flexible hairspray shield of claim 11 further comprising:

(a) the first flattened side having the taller side extending from a heel section; and (b) the taller side extending from the heel section.

13. The flexible hairspray shield of claim 12 further comprising:

(a) the hinge being secured to the ear-covering section;

(b) the releasable connecting means having hooks of the hook and loop assembly secured to a first member of the temple-covering section;

(c) the releasable connecting means having loops of the hook and loop assembly secured to a second member of the temple-covering section; and (d) the first member of the temple-covering section being oppositely disposable from the second member of the temple-covering section.

14. The flexible hairspray shield of claim 13 further comprising:

(a) the hinge permitting the reversing of the first flattened side relative to the second flattened side; and (b) the first member of the temple-covering section being reversibly and oppositely disposable from the second member of the temple-covering section.

15. A method of applying hairspray comprising:

providing a flexible hairspray shield;

protecting a first desired area of a face with a first surface of the flexible hairspray shield;

applying hairspray to hair on a human head, the hair being adjacent to the flexible hairspray shield;

changing the first surface of the flexible hairspray shield to a second surface of the flexible hairspray shield;

protecting a second desired area of a face with a second surface of the flexible hairspray shield;

applying hairspray to hair on a human head, the hair being adjacent to the hairspray shield;

the hairspray shield having a first flattened side connected to a second flattened side;

a movable connecting means joining the first flattened side to the second flattened side;

the first flattened being substantially similar in shape to the second flattened side;

a releasable connecting means realizable joining the first flattened side to the second flattened side;

the movable connecting means being a flexible hinge;

the releasable connecting means being a hook and loop assembly;

the flexible hinge having a first flexible member and a second flexible member;

the first flexible member being joined to the second flexible member at a center portion thereof;

the first flexible member and the second flexible member each having adjacent first ends oppositely disposed from adjacent second ends;

the adjacent first ends being secured to the first flattened side on opposite flat surfaces thereof;

the adjacent second ends being secured to the first flattened side to the second flattened side on opposite flat surfaces thereof;

the first flattened side being positionable adjacent to the second flattened side; and the first flattened side being alternatively and reversibly positionable adjacent to the second flattened side, thereby permitting four usable surfaces of the flexible hairspray shield.

16. A flexible hairspray shield, the hair spray shield comprising:

(a) a first flattened side being connected to a second flattened side;

(b) a movable connecting means joining the first flattened side to the second flattened side;

(c) the first flattened being substantially similar in shape to the second flattened side;

(d) a releasable connecting means realizable joining the first flattened side to the second flattened side;

(e) the movable connecting means being a flexible hinge;

(f) the releasable connecting means being a cooperating hook and loop assembly;

(g) the flexible hinge having a first flexible member and a second flexible member;

(h) the first flexible member being joined to the second flexible member at a center portion thereof;

(i) the first flexible member and the second flexible member each having adjacent first ends oppositely disposed from adjacent second ends; and (j) the adjacent first ends being secured to the first flattened side on opposite flat surfaces thereof.

17. The flexible hairspray shield of claim 18, further comprising:

(a) the adjacent second ends being secured to the first flattened side to the second flattened side on opposite flat surfaces thereof;

(b) the first flattened side being positionable adjacent to the second flattened side;

(c) the first flattened side being alternatively and reversibly positionable adjacent to the second flattened side, thereby permitting four usable surfaces of the flexible hairspray shield;

(d) the first flattened side having and the second flattened side having a center portion;

(e) the center portion having a first coverable side and a second coverable side;

(f) a first covering for the first coverable side and the second coverable side;

(g) a second covering for the second coverable side;

(h) the center portion having a structure selected from the group consisting of a foam structure and a flexible paper structure; and (i) the first covering and the second covering being selected from the group consisting of an absorbing woven fabric panel and a sheet panel.

* * * * *